US007887387B2

(12) United States Patent
Colvin

(10) Patent No.: US 7,887,387 B2
(45) Date of Patent: Feb. 15, 2011

(54) STUFFED TOY WITH REMOVABLE AND REPLACEABLE STUFFING, AND METHOD FOR USE THEREOF

(75) Inventor: Joan Marie Colvin, Carlsbad, CA (US)

(73) Assignee: Originates, Inc., Carlsbad, CA (US)

( * ) Notice: Subject to any disclaimer, the term of this patent is extended or adjusted under 35 U.S.C. 154(b) by 310 days.

(21) Appl. No.: 11/375,741

(22) Filed: Mar. 14, 2006

(65) Prior Publication Data

US 2006/0205319 A1 Sep. 14, 2006

Related U.S. Application Data

(60) Provisional application No. 60/661,453, filed on Mar. 14, 2005.

(51) Int. Cl.
*A63H 3/02* (2006.01)
*A63H 3/00* (2006.01)

(52) U.S. Cl. ..... 446/369; 446/370; 446/379

(58) Field of Classification Search ..... 446/25–27, 446/72–75, 299, 302, 369–371, 901; 281/15.1, 281/21.1
See application file for complete search history.

(56) References Cited

U.S. PATENT DOCUMENTS 3,729,865 A * 5/1973 Naunheim ..... 446/72
4,822,285 A 4/1989 Summerville
4,909,542 A * 3/1990 Marks ..... 281/15.1
4,917,607 A * 4/1990 Van Hoose ..... 434/236
5,356,295 A 10/1994 Grosz
5,472,364 A * 12/1995 Castleman ..... 446/71
5,749,764 A * 5/1998 Bailey ..... 446/427
6,030,274 A * 2/2000 Kaplan ..... 446/369
6,254,450 B1 * 7/2001 Schonberger ..... 446/72
6,264,526 B1 * 7/2001 Meeker ..... 446/369
6,527,617 B1 3/2003 Capozzi et al.
6,663,459 B2 * 12/2003 Ostolaza ..... 446/75
6,685,532 B1 2/2004 McLean
6,755,712 B2 * 6/2004 Morris ..... 446/98
6,786,792 B2 9/2004 Ritchey

* cited by examiner

*Primary Examiner*—Kien T Nguyen
(74) *Attorney, Agent, or Firm*—Mintz, Levin, Cohn, Ferris, Glovsky and Popeo, P.C.

(57) ABSTRACT

An unstuffed shell sewn from plush fabric has one or more openable and resealable seams allowing for insertion and removal of several stuffing components. Each of the stuffing components comprises an outer fabric surface enclosing a stuffing material. The stuffing components are shaped to fit within and fill out specific areas of the unstuffed shell, for example, the head, arms, legs and torso of the shell. Each stuffing component has a unique identifying feature, which may be color, labels or shape, or a combination of two or more identifying features. In the preferred embodiment, each stuffing component is uniquely identified by color, with an optional tag or imprinted or embroidered label attached to the fabric. The tag or label may having writing or an image to convey a thought or message. In an exemplary embodiment, each stuffing component corresponds to one or more personal characteristics or qualities that are described in a storybook that is read by or to a child to teach character building. The stuffing components can be repeatedly inserted and removed to reinforce the child's understanding.

9 Claims, 6 Drawing Sheets

STUFFED TOY WITH REMOVABLE AND REPLACEABLE STUFFING, AND METHOD FOR USE THEREOF

RELATED APPLICATIONS

This application claims the benefit of priority of U.S. provisional application No. 60/661,453, filed Mar. 14, 2005, the disclosure of which is incorporated herein by reference in its entirety.

FIELD OF THE INVENTION

The present invention relates to a stuffed toy for use in teaching or communicating a message and more particularly to a stuffed toy with stuffing units that can be removed and replaced, where the stuffing units have a message or concept associated therewith.

BACKGROUND OF THE INVENTION

Stuffed and plush toys have long been popular among children and adults of all ages. In recent years, activities have been made available for children to participate in workshops that allow the child to make a personalized stuffed toy. For example, the company Build-a-Bear Workshop, Inc. conducts parties and events at which a participant can select a type of toy by choosing a plush shell, filling it with resilient material such as a polyester fiberfill, and customizing it by adding clothing, sound chips and other accessories. After the stuffing and selected components are placed inside the shell, the opening through which the toy was filled is sewn closed. This process allows the participant to feel as though he or she had brought the stuffed animal to life, resulting in a stronger association of the "builder" with the toy. A number of patents have been directed to methods for making such toys, including U.S. Pat. No. 6,527,617 of Capozzi, et al., and U.S. Pat. No. 6,685,532 of McLean, which are incorporated herein by reference. Because the toys are filled with a loose stuffing material, they must be sewn shut. Thus, the excitement of seeing the toy take form is limited to the initial experience.

Other stuffed toys have been created with portions of the toy that are openable and resealable to remove components. For example, U.S. Pat. No. 4,822,285 of Summerville discloses an anatomically stuffed toy that includes an openable flap that, when opened, reveals stuffed organs that are located in anatomically correct positions. However, the main body of the toy is stuffed with a conventional stuffing and sewn closed such that the toy is fully filled and sealed apart from the flap area. Another U.S. Pat. No. 5,356,295 of Grosz, describes a stuffed doll with openable panels that reveal templates that approximate the shape and location of anatomical parts. Again, the main body of the toy is conventionally stuffed and sewn closed. The disclosures of both patents are incorporated herein by reference.

A stuffed toy for pets is described in U.S. Pat. No. 6,786,792 of Ritchey (incorporated herein by reference) in which outer and inner shells are assembled to create a pouch that holds a play-stimulation item such as a squeaker or catnip. The pouch is sealed with Velcro®, allowing the item to be replaced when the item is worn out or stale. Certain areas of the shells may be stuffed with polyester fiberfill and sewn closed to give shape to features, such as a head or legs.

The ability to open a stuffed toy, remove the stuffing and then replace it creates the opportunity for use of the stuffing itself as a toy and to teach a lesson or convey a message, and allows the child to relive the excitement of bringing the toy "to life". The present invention is directed to such a toy and the method of using it.

BRIEF SUMMARY OF THE INVENTION

In an exemplary embodiment, the present invention comprises an unstuffed shell sewn from plush fabric or other appropriate fabric which has one or more openable and resealable seams allowing for insertion and removal of several stuffing components. The openable/resealable seam may be sealed with a Velcro® hook-and-pile fastener, snaps or buttons, a zipper, laces threaded through eyelets, or other appropriate fastener(s). In the preferred embodiment, each of the stuffing components comprises an outer fabric surface enclosing a foam, fiberfill, polystyrene beads or other appropriate stuffing material. The outer fabric of the stuffing components may be velour, nylon, satin, plush, polyester or any fabric, including netting or mesh, that retains the stuffing within a unit that is durable to stand up under repeated handling and pulling, and preferably pleasant to the touch. The stuffing components are shaped to fit within and fill out specific areas of the unstuffed shell, for example, the head, arms, legs and torso of the shell. Each stuffing component has a unique identifying feature, which may be color, labels or shape, or a combination of two or more identifying features. In the preferred embodiment, each stuffing component is uniquely identified by color, with an optional tag or imprinted or embroidered label attached to the fabric. The tag or label may having writing or an image to convey a thought or message.

In an exemplary embodiment, a method for teaching a lesson or communicating a message combines a stuffed toy with removable, replaceable stuffing components with a storybook that provides explanations of different personality characteristics and character traits that are associated with the individual stuffing components that are inserted into designated areas within the stuffed toy. In the exemplary embodiment, the stuffed toy is a teddy bear, however, other characters, including other animals, dolls, or other toy shapes may be used.

In the exemplary embodiment, the toy shell has a single opening in the center of its back. Six stuffing components are provided for filling the head, torso, right and left arms, and right and left legs of the teddy bear. Because there is a single opening for insertion of the stuffing components, the head and extremities of the toy should filled before filling the torso. Alternatively, multiple closeable openings may be used to allow stuffing components to inserted and removed in different orders. The story line of the book guides the user to insert the stuffing in the appropriate order. The stuffing component for filling the head is pink and may be labeled "Brain" or "My Brain". In the accompanying story, the head stuffing component is associated with the functions and personality characteristics of thinking, knowledge and power. The stuffing component for filling the right arm is blue and may be labeled "Right hand" or with one or more of the characteristics associated with the right hand according to the story, which include friendship, fairness and sharing. The stuffing component for the left arm is green and may be labeled "Left hand" or with one or more of the characteristics associated with the left hand according to the story, including responsibility, discipline and truth. The stuffing component for the left leg is purple and may be labeled "Left foot" or with one or more of the characteristics associated with the left foot according to the story. Possible characteristics include courage, trustworthiness and honesty. The stuffing component for the right leg is yellow and may be labeled "Right foot" or with one of the associated character traits including respect, happiness, or a smile or good deed.

After the head and extremities are stuffed, the stuffing component for the torso is inserted. This final stuffing component is formed in the shape of a heart and is sized so as to fill the entire torso of the toy. The outer fabric is preferably red, and a label with "Heart", "My Heart" or its associated characteristics may be attached or applied to the fabric. Associated characteristics can include love, caring and helpfulness. After the final stuffing component is inserted, the seam can be sealed using the reopenable fastener. The sealed area can include a sewn on label or embroidery with a message such as "You make me complete."

The stuffing components can be repeatedly removed from the shell and replaced, allowing the toy's owner to again enjoy the act of filling the toy to give it form. Preferably, the rebuilding of the toy will be accompanied by a story that can be read by the child to him or herself, by a group of children, or by a parent to the child.

In the exemplary method of the present invention, the child reads or is read an explanatory story in conjunction with inserting the stuffing components in the toy. The story is printed in a book. As the child reads or is read the story, each stuffing component is associated with a personality characteristic or character trait that is described in the story. As will be readily apparent, the stuffing components are not limited to association with the traits identified in the exemplary embodiment, but can be associated with any number of different qualities or personality traits that can be described in and made part of a story line in one or more additional books. Other possible positive traits include, but are not limited to, generosity, neatness, forgiveness, open-mindedness, tolerance, perkiness, spunk, flexibility, imagination, being observant, creativity, promptness, etc. The list of qualities and personality traits that can be associated with one or more stuffing components is virtually endless. In one embodiment, one or more additional stuffing components can be included for association with some negative traits to help a child understand what traits they might not want to include in their toy. For example, being selfish, whiny or disrespectful could be associated with a small grey or black stuffing component. In one embodiment, the negative characteristic component can be shaped as a flattened disk or other shape that fits into the head or torso of the toy along the inside surface of the shell so as to not create a lump. The negative characteristic component can be removed as part of the story where the toy, and thus, the child, learns that other people's feelings may be hurt by, e.g., selfish or rude behavior. Alternatively, the negative characteristic component could be shaped to make the toy lumpy so that the toy will become smooth and more appealing when the negative characteristics are removed. Also, traits such as shyness or fear could be represented by a stuffing component that can be removed from the toy as part of a story to help a child grasp the concept of having the power to overcome a difficult situation.

According to the story, by placing the stuffing component in the toy, the toy is imbued with the described character traits. In the cases of negative traits, the corresponding stuffing component can be removed or left out of the toy to avoid giving the toy's "personality" that undesirable trait. By combining the act of stuffing the toy with the reading of the story that describes the meaning of the stuffing components, the child learns the significance of the personality characteristics and the positive values associated with them. The child builds a toy that is perceived as possessing the described positive characteristics and, where used, overcoming or avoiding negative characteristics. Additional stories can be written to emphasize different character traits or add new character traits to those previously introduced in the original story and any subsequent stories. The additional stories introduce different life situations or different fantasy situations in which new character traits come into play, for example, curiosity in the face of adventure, bravery and persistence in overcoming a challenge, or meeting new people.

The stuffing components need not be limited to those described in the exemplary embodiment, but can be varied in size, color, quantity and associated character traits.

In the preferred embodiment, the toy and story book are retained within a backpack that allows the child to easily carry the toy along with them. The backpack provides a convenient means for holding the unstuffed toy shell and the stuffing components so that the separate components are not lost, but can also carry the fully assembled toy along with the story book.

In an alternate embodiment, the toy can be used to convey a message. For example, in a couple that is dating, going steady or married, one may give the other a stuffed toy to express affection. The stuffing components may have a tag or the surface of each stuffing component can be embroidered with one or more words to convey a thought or feeling. For example, the stuffing component that fills the head of the toy can have the message "you are always on my mind", or "warm thoughts". The stuffing component for the arms can say "I want to wrap my left (right) arm around you", or possibly, "Hug-Part 1" and "Hug-Part 2". The stuffing for the legs could say "I'd follow you anywhere", and the heart/torso component could have the message "I love you" or "my heart is in your hands". The toy for conveying a message of affection could also come with a book with a set of rhymes or phrases that describe feelings associated with the stuffing component. In addition, a label could be attached to the closure with the phrase, for example, "You complete me."

The toy can be adapted to virtually any situation in which someone may wish to convey a message, including, for example, a get-well-soon wish, an apology, congratulations, graduation, etc.

Additional features and details of the invention will become apparent from viewing the accompanying figures and detailed description of the exemplary embodiments.

BRIEF DESCRIPTION OF THE FIGURES

Understanding of the present invention will be facilitated by consideration of the following detailed description of a preferred embodiment of the present invention taken in conjunction with the accompanying drawings, in which like numerals refer to like parts.

DETAILED DESCRIPTION OF THE EXEMPLARY EMBODIMENTS

Figure 1:
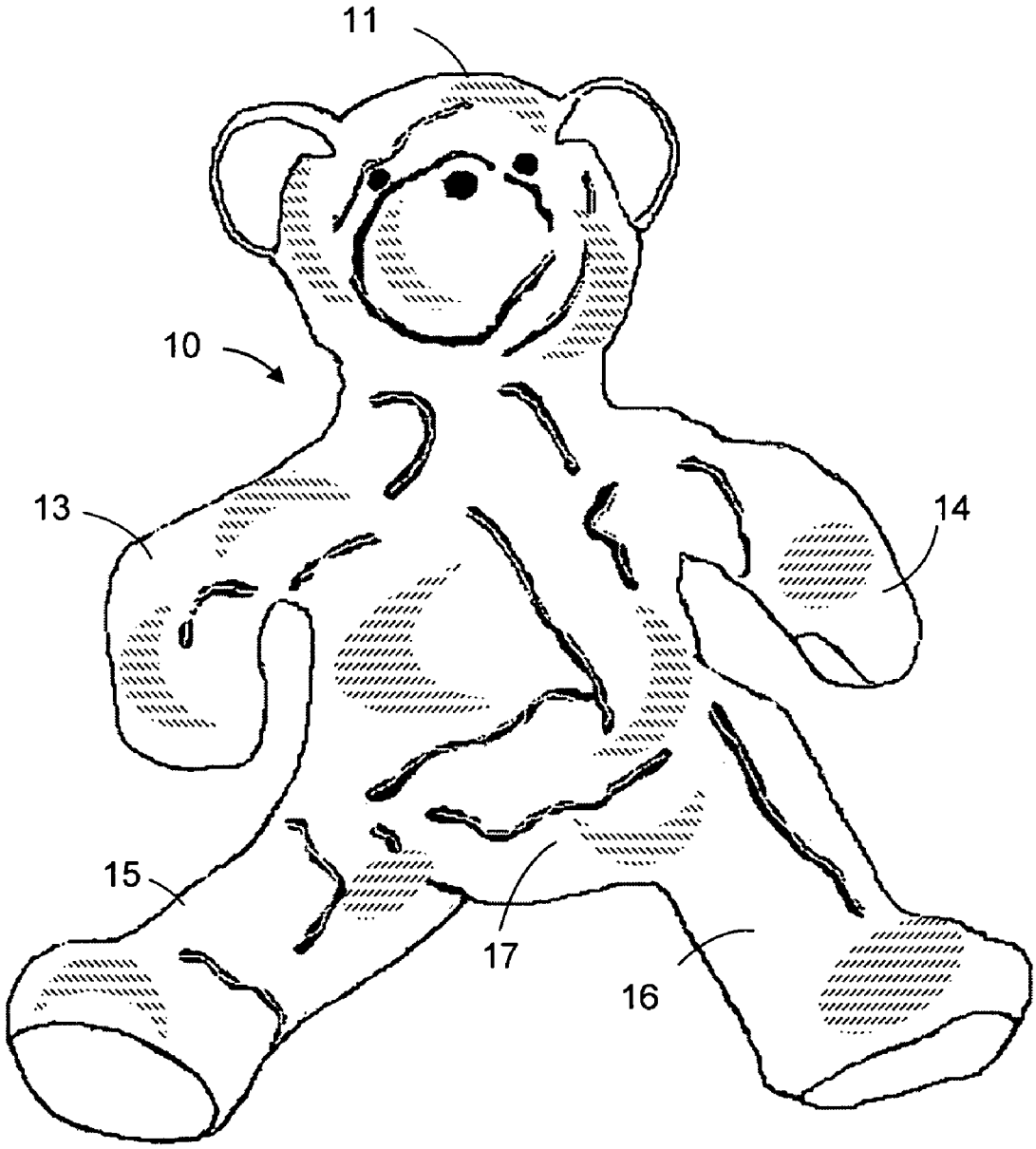
FIG. 1 is a front view of the unstuffed toy shell.
Figure 2:
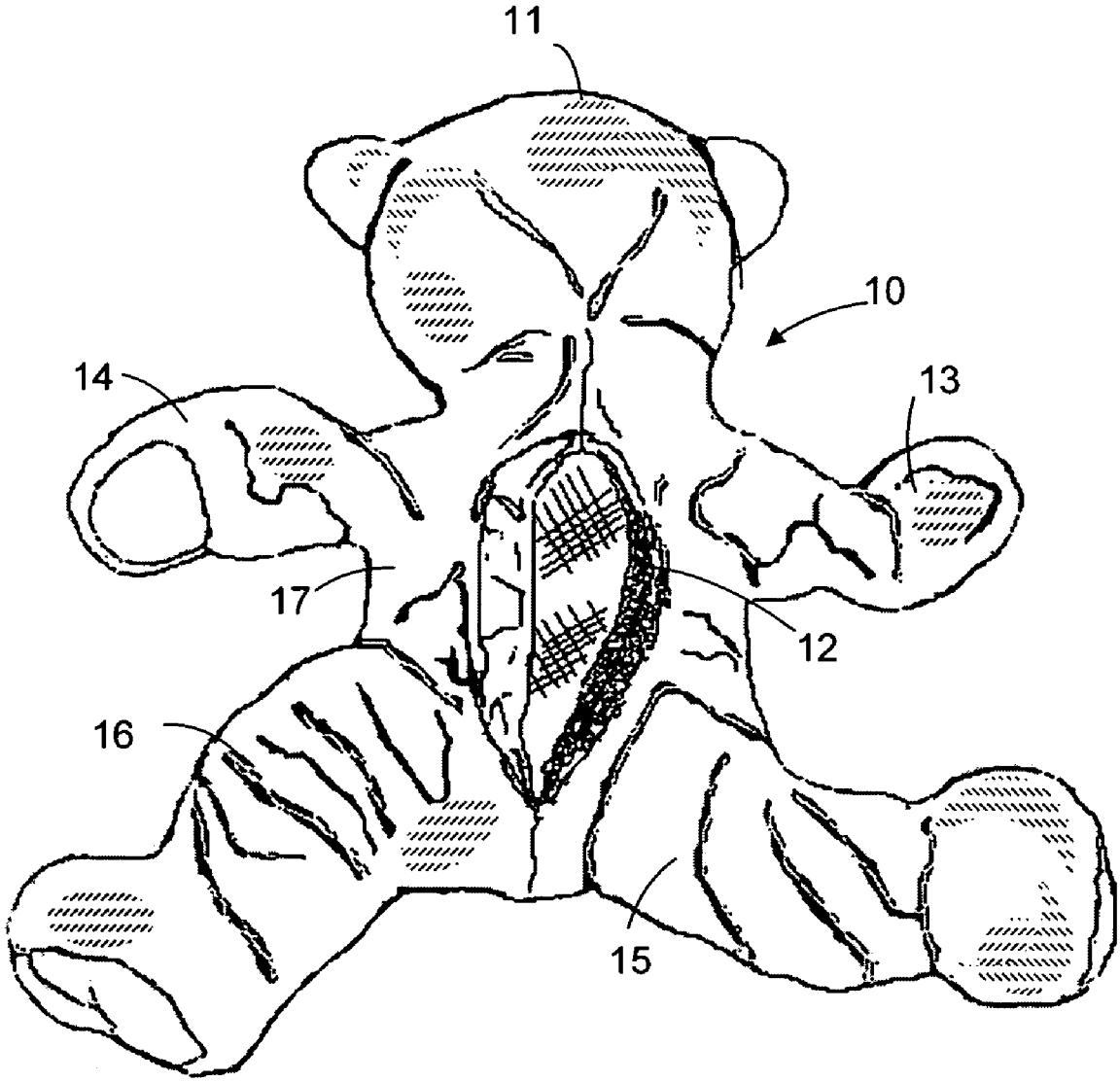
FIG. 2 is a rear view of the unstuffed toy shell showing the opening for insertion of the stuffing components.
Figure 3:
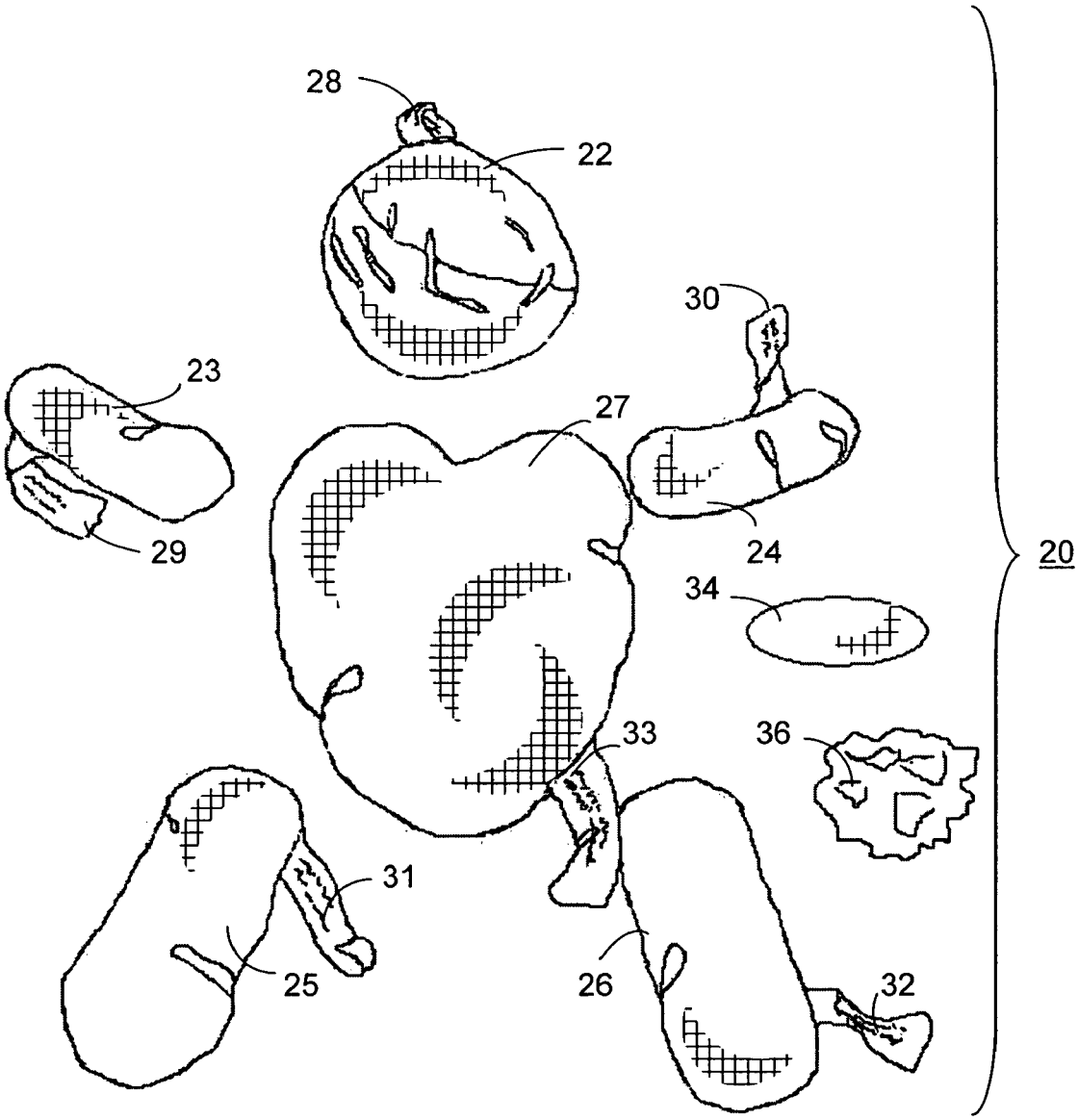
FIG. 3 is a front view of the individual stuffing components according to the exemplary embodiment.

As illustrated in FIGS. 1 and 2, unstuffed shell 10 is sewn from plush fabric or other appropriate fabric and has one or more openable and resealable seams 12 that allows for insertion and removal of several stuffing components 20, examples of which are shown in FIG. 3. For purposes of illustration, the toy is a teddy bear, but it will be readily apparent that other animals or even human-like dolls may be similarly constructed. The openable/resealable seam 12 may be sealed with a Velcro® hook-and-pile fastener, as illustrated, snaps or buttons, a zipper, laces threaded through eyelets, or other appropriate fastener(s). The seam or seams 12 need not be located in the back of the toy, but can be located anywhere on the shell that allows access to insert the stuffing components into the sections to be stuffed.

In the preferred embodiment, each of the stuffing components 20 comprises an outer fabric surface enclosing a foam, fiberfill, polystyrene (Styrofoam®) beads or other appropriate stuffing material. The outer fabric of the stuffing components can be velour, nylon, satin, plush, polyester, mesh or netting, or any fabric that is capable of retaining the loose stuffing in a unit, durable enough to withstand repeated handling and pulling, and preferably pleasant to the touch. The stuffing components are shaped to fit within and fill out specific areas of the unstuffed shell, for example, the head, arms, legs and torso of the shell. Each stuffing component has a unique identifying feature, which may be color, labels or shape, or a combination of two or more identifying features. In the preferred embodiment, each stuffing component is uniquely identified by color, with an optional tag 28-33, as shown, or an imprinted or embroidered label attached to or sewn directly into the fabric.

In an exemplary embodiment, a method for teaching a lesson or communicating a message combines a stuffed toy with removable, replaceable stuffing components with a storybook that provides explanations of different personality characteristics and character traits that are associated with the individual stuffing components that are inserted into designated areas within the stuffed toy. The storybook also provides instructions for inserting the stuffing component. According to the story, the insertion of the identified stuffing component into the shell imparts the corresponding characteristic or quality to the toy. In the exemplary embodiment, the stuffed toy is a teddy bear, however, other characters, including other animals, dolls, or other toy shapes may be used.

In the exemplary embodiment, the toy shell 10 has a single opening 12 in the center of its back. Six stuffing components are provided for filling the head 22, torso 27, right arm 24, left arm 23, right leg 26 and left leg 26 of the teddy bear. Because there is a single opening for insertion of the stuffing components, the head and extremities of the toy should filled before filling the torso. The stuffing component 22 for filling the head 11 is pink and may have the word(s) "Brain" or "My Brain" on the label 28. In the accompanying story, the head stuffing component is associated with the functions and personality characteristics of thinking, knowledge and power. The stuffing component 24 for filling the right arm 13 is blue and may have "Right hand" or one or more of the characteristics associated with the right hand on the label 30. In the exemplary story, the qualities include friendship, fairness and sharing. The stuffing component 23 for the left arm 14 is green and may have "Left hand" or with one or more of the characteristics that is associated with the left hand, according to the story, on the label 29. Possible characteristics include responsibility, discipline and truth. The stuffing component 25 for the left leg 16 is purple and may have "Left foot" or a word conveying one or more of the characteristics on the label 31 which, according to the story, is associated with the left foot. Possible characteristics include courage, trustworthiness and honesty. The stuffing component 26 for the right leg 15 is yellow and may have "Right foot" or with one of the associated character traits on the label 32. Characteristics or qualities may include happiness, or a smile or good deed.

Figure 4:
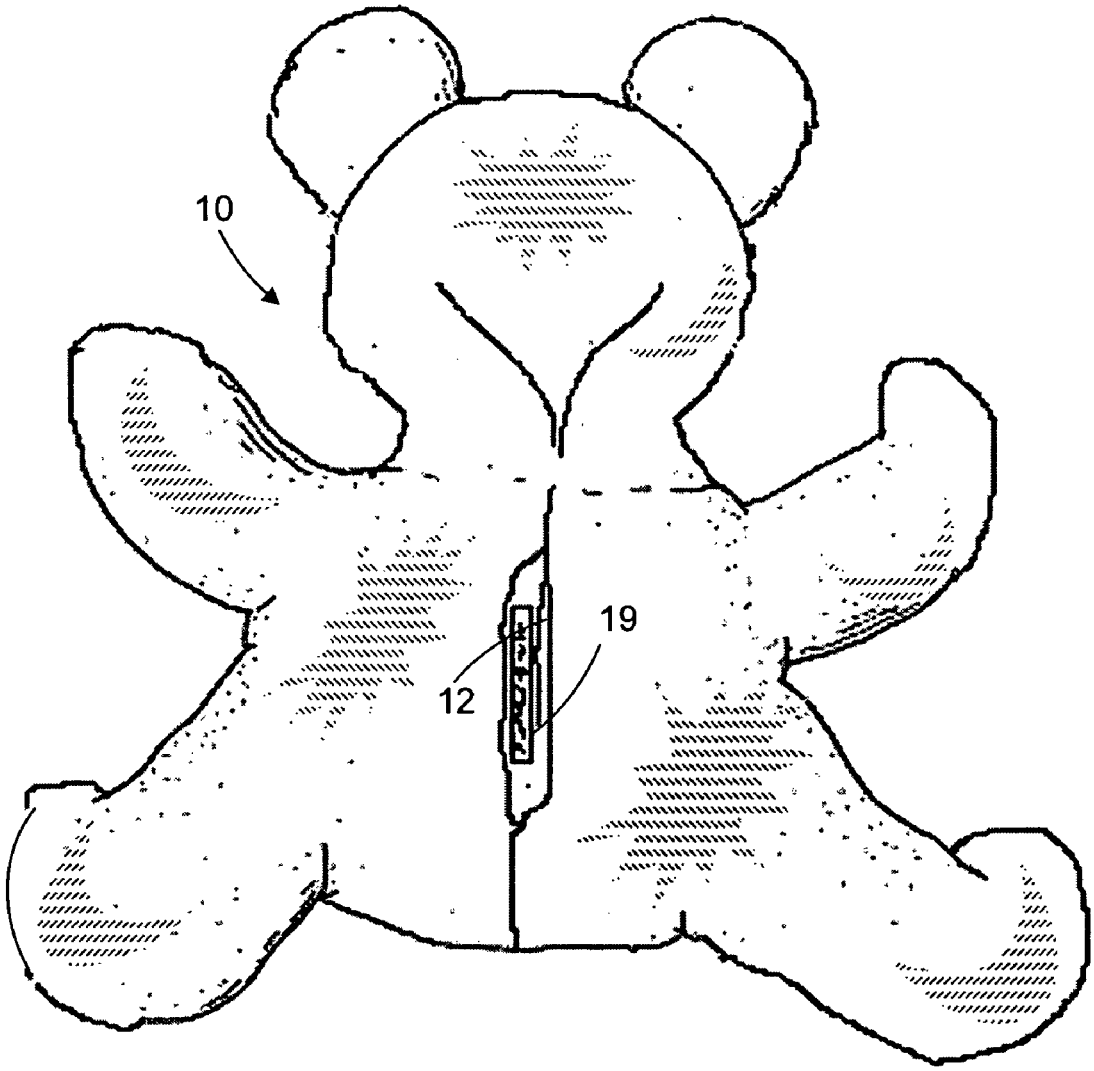
FIG. 4 is a rear view of the stuffed toy after insertion of the stuffing components.

After the head and extremities are stuffed, the stuffing component 27 for the torso 17 is inserted. This final stuffing component is formed in the shape of a heart and is sized so as to fill the entire torso of the toy. The outer fabric is preferably red and a label of "Heart", "My Heart" or its associated characteristics may be applied. Associated characteristics can include love, caring and helpfulness. After the final stuffing component 27 is inserted, the seam 12 can be sealed using the reopenable fastener. In the preferred embodiment, the reopenable fastener is a hook-and-pil type fastener such as Velcro®. As shown in the completed toy of FIG. 4, the outer edge of seam 12 can include a sewn on label 19 or embroidery with a message such as "You make me complete."

The seam 12 closure can be reopened and stuffing components 20 can be removed from the shell, generally in the reverse order in which they were inserted. They can then be replaced, allowing the toy's owner to repeatedly enjoy the act of filling the toy to give it form. The act of refilling the toy with the stuffing components helps to reinforce the message associated with each component. Preferably, the rebuilding of the toy will be accompanied with a story that can be read by the child to him or herself, by a group of children, or by a parent to the child.

Figure 6A:
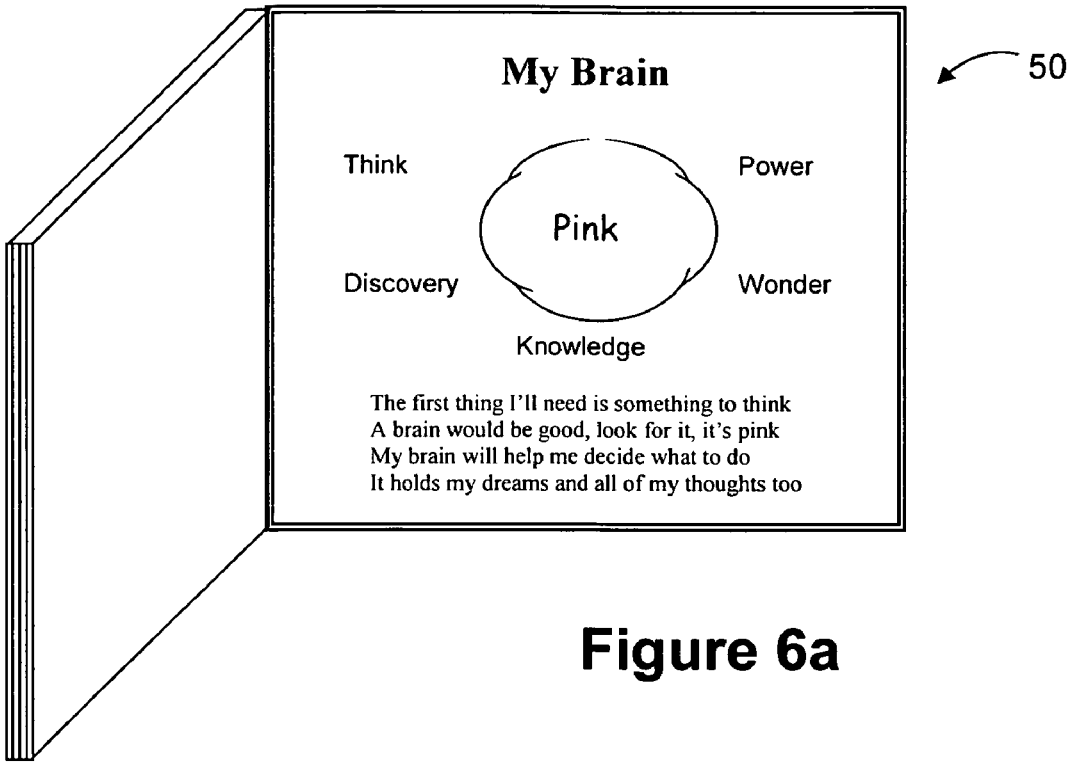
FIGS. 6*a* and 6*b* are exemplary pages of a storybook describing a stuffing component for the toy.
Figure 6B:
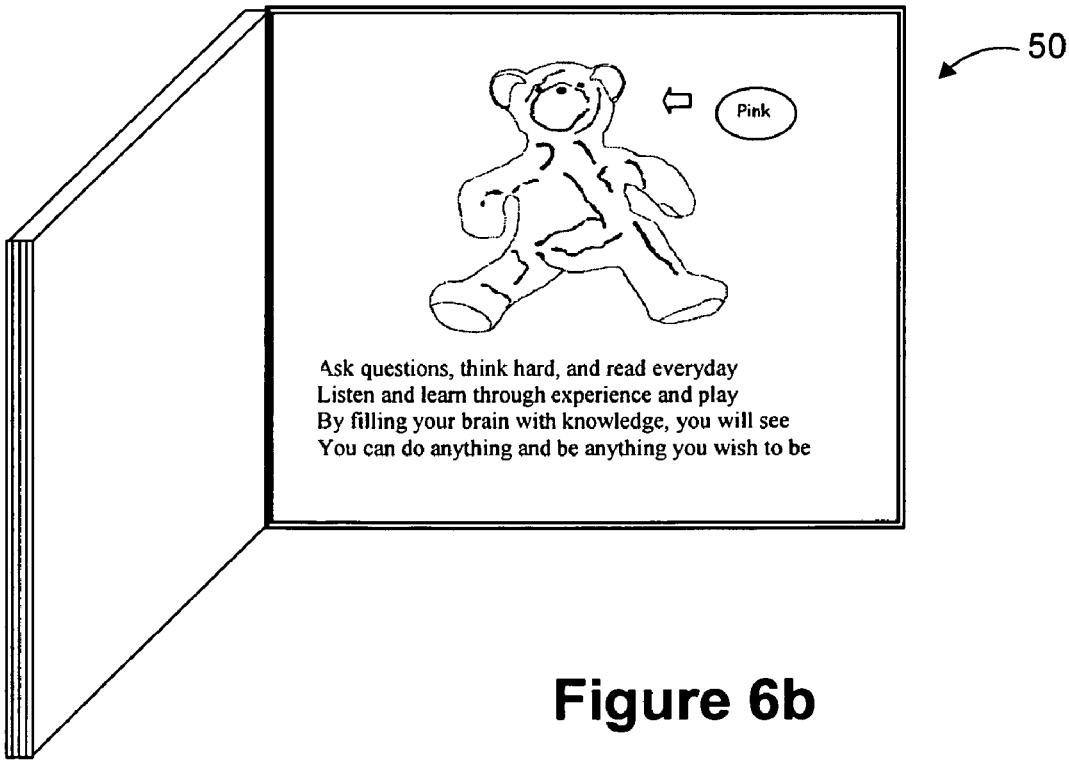

FIGS. 6*a* and 6*b* illustrate exemplary pages from a storybook 50 that provides descriptions of the parts and their associated messages or qualities in an entertaining format. Still using the example described above, a drawing of the stuffing component 22 for the head 11 is associated with the brain. The good characteristics/functions of the brain that are being conveyed include "think", "discovery", "power", "wonder" and "knowledge". Where the stuffing components have different colors, the book 50 also describes the color of the component, which in the example is pink. The rhyme in the book has a pleasant sound that helps convey the positive aspects of the characteristics of the brain and describes activities that help the child further develop these positive qualities, such as thinking hard and reading, listening and learning. It also includes encouraging and self-esteem building language that if the child focuses on and develops these positive characteristics, he or she "can do anything and be anything you wish to be".

One aspect of character building includes teaching the child about qualities that are undesirable. Lessons of this type can include the use of stuffing components that can be removed from the toy. In one embodiment, the negative characteristic stuffing component can be shaped as a flattened disk 34 or other shape that fits into the head or torso of the toy along the inside surface of the shell so as to not create a lump, and be removed as part of the story where the toy's character learns that other people's feelings may be hurt by, e.g., selfish or rude behavior, or jealousy. Alternatively, the negative characteristic stuffing component 36 can be shaped and stuffed to have an irregular surface and/or be less compressible to make the toy lumpy so that the toy will become smooth and more appealing when the negative characteristic is removed. Additional personality traits such as shyness or fear can be associated with a stuffing component that can be removed from the toy as part of the story to help a child grasp the concept of overcoming a difficult situation that can be more easily overcome with the right attitude and belief that the child has the ability to make a difference by thinking positive.

Figure 5:
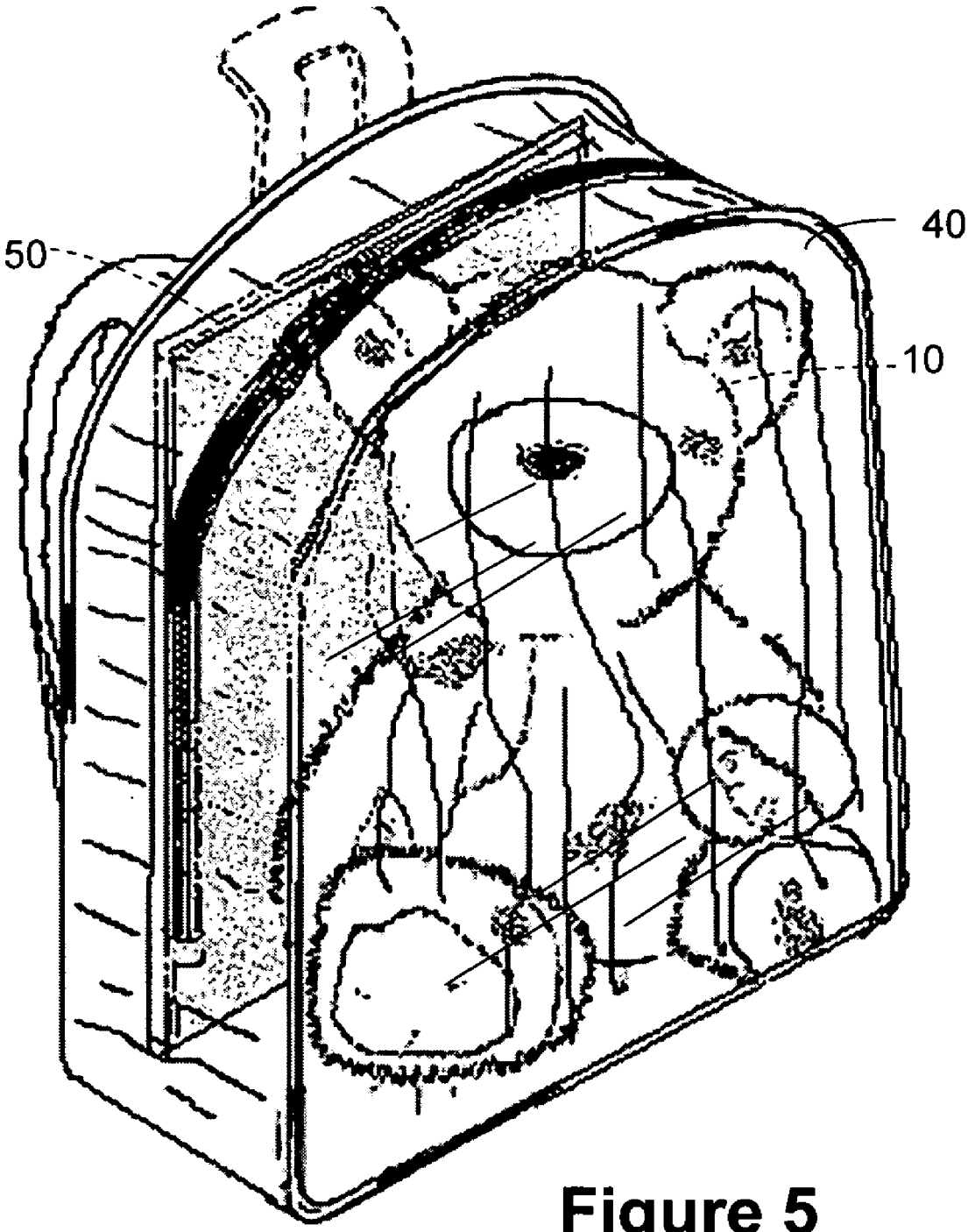
FIG. 5 is a front view of an exemplary back pack for carrying the toy and accompanying story book.

FIG. 5 illustrates a backpack 40 that allows the child to easily carry the toy along with them. The backpack has a zipper or other closure to provide a convenient means for holding the unstuffed toy shell 10 and the stuffing components 20 so that the separate components are not lost, and can also carry the fully assembled toy along with the storybook 50, as illustrated. Preferably, the backpack is made of a transparent vinyl or vinyl-like material to allow the toy and book to be seen within the carrier. Other carrying means can also be used, such as a drawstring bag or molded plastic case. The carrier, toy, stuffing components and storybook can be sold as a kit, with additional stuffing components and storybooks available separately to teach additional lessons or convey additional messages.

The stuffed toy and method for teaching a lesson or conveying a message can be used for communicating any number of messages and is not limited to teaching character traits to children as described in the exemplary embodiment.

Other embodiments and modifications of the present invention will occur readily to those of ordinary skill in the art in view of these teachings. Therefore, this invention is to be limited only by the following claims which include all such other embodiments and modifications when viewed in conjunction with the above specification and accompanying drawings.

What is claimed is:

1. A stuffed toy for conveying a message comprising:

a fabric shell having a plurality of areas, each area for receiving one resilient stuffing unit, the fabric shell further having one openable and resealable closure through which the stuffing is inserted into or removed from each of the plurality of areas of the fabric shell to fill and give a predetermined form to each one of the plurality of areas and the stuffed toy; and a plurality of discrete resilient stuffing units, each resilient stuffing unit comprising a fabric cover enclosing a resilient stuffing material and having a unique shape that is adapted to fill a particular area of the plurality of areas via the one openable and resealable closure to give the predetermined form to the particular area with the unique shape, the fabric cover of each stuffing unit having a different color corresponding to the particular area, each stuffing unit further having a different message associated therewith, wherein insertion of the stuffing units into the fabric shell symbolizes instilling of a plurality of thoughts or characteristics corresponding to the different messages associated with the stuffing units to the stuffed toy, and wherein the stuffing units are removable from and replaceable into a corresponding particular area of the plurality of areas of the fabric shell in a particular order to provide or remove a form to the stuffed toy for reinforcing the different messages and their corresponding thoughts and characteristics associated with the stuffing units, the particular order being associated with the different color of each fabric cover.

2. The stuffed toy as in claim 1, wherein the different message is associated with each of the stuffing units by a label disposed on the stuffing unit, and wherein each stuffing unit has a different label.

3. The stuffed toy as in claim 1, wherein the message is associated with each of the stuffing units by a different storybook that provides instructions for inserting the stuffing components.

4. The stuffed toy as in claim 3, wherein the message comprises a personal quality or characteristic, and the storybook associates the stuffing units with character building.

5. The stuffed toy as in claim 3, wherein the message comprises a negative quality or characteristic that is removed from the fabric shell.

6. A method for teaching character traits to a child, the method comprising:

providing an unstuffed toy shell formed from fabric, the shell having a head portion, a torso portion and a plurality of extremities, and one opening with a reopenable fastener for sealing the at least one opening;

providing a plurality of discrete stuffing components, each stuffing component comprising a fabric cover enclosing a resilient stuffing material, each fabric cover having a unique color being formed in a unique shape to correspond to and fill one of the head portion, the torso portion and the plurality of extremities in a particular order so that insertion of a stuffing component into its corresponding portion of the shell fills the shell, wherein each stuffing component has a unique appearance and corresponds to a unique character trait, the particular order being associated with the unique color of each fabric cover;

reading a descriptive story in a separate storybook that describes the unique character trait and associates the unique character trait with its corresponding stuffing component;

inserting one stuffing component into one of the plurality of extremities as the associated one or more character trait is described in the story, whereby the unique character trait is incorporated into the fabric shell;

repeating the step of inserting one stuffing component until the plurality of stuffing components is inserted into all of the plurality of extremities in the shell and a plurality of character traits are incorporated into the fabric shell; and releasably sealing the shell.

7. The method of claim 6, wherein the character trait is associated with each of the stuffing component by a label disposed on the stuffing component, and wherein each stuffing component has a different label.

8. The method of claim 6, further comprising one or more negative characteristic stuffing component, wherein the child removes the negative characteristic stuffing component before or after inserting one stuffing component.

9. A toy comprising:

A fabric shell having a plurality of areas, each area being accessible from one of the plurality of areas, the one of the plurality of areas including one sealable opening;

A plurality of discrete resilient stuffing units, each resilient stuffing unit comprising a fabric cover enclosing a resilient stuffing material and having a unique shape that is adapted to fill a particular area of the plurality of areas via the one sealable opening to give a predetermined form to the particular area with the predetermined shape, the fabric cover of each stuffing unit having a different color corresponding to the particular area, each stuffing unit further having a different message associated therewith, the resilient stuffing units being insertable into and removable from a corresponding particular area of the plurality of areas of the fabric shell in a particular order to provide or remove a shape to the toy for reinforcing the different messages associated with the stuffing units, the particular order being associated with the different color of each fabric cover; and a story book depicting the toy and having a story that represents the different messages, the story further providing instructions for inserting and removing the resilient stuffing units in the particular order.

* * * * *

UNITED STATES PATENT AND TRADEMARK OFFICE

CERTIFICATE OF CORRECTION

PATENT NO. : 7,887,387 B2
APPLICATION NO. : 11/375741
DATED : February 15, 2011
INVENTOR(S) : Joan M. Colvin It is certified that error appears in the above-identified patent and that said Letters Patent is hereby corrected as shown below:

Column 8, line 45, claim 9 should read --a plurality of discrete resilient stuffing units, each resilient--

Signed and Sealed this
Tenth Day of April, 2012

David J. Kappos

David J. Kappos
*Director of the United States Patent and Trademark Office*